US005528775A

United States Patent [19]

Marenda

[11] Patent Number: 5,528,775

[45] Date of Patent: Jun. 25, 1996

[54] WOMEN'S ABDOMINAL SUPPORT GARMENT

[76] Inventor: Madonna A. Marenda, 401 W. Caroline St., Spring Valley, Ill. 61362

[21] Appl. No.: 308,644

[22] Filed: Sep. 19, 1994

[51] Int. Cl.[6] ..... A41B 9/00; A41B 9/04

[52] U.S. Cl. ..... 2/406; 2/400; 2/401; 450/115; 450/117

[58] Field of Search ..... 2/67, 73, 400, 2/401, 402, 403, 406; 450/114, 115, 116, 117, 119, 120, 121, 130, 132, 154; D2/702, 704, 712, 736, 738

[56] References Cited

U.S. PATENT DOCUMENTS

| | | | |
|---|---|---|---|
| 2,250,506 | 7/1941 | Snyder . | |
| 3,333,589 | 8/1967 | Cohen et al. | 2/67 X |
| 4,476,895 | 10/1984 | Shibusawa | 2/401 X |
| 4,596,253 | 6/1986 | Griffith . | |
| 4,867,301 | 2/1989 | Ferber | 450/150 X |
| 4,920,769 | 5/1990 | Rickerl | 2/406 X |
| 5,023,957 | 6/1991 | Harvey . | |
| 5,120,264 | 6/1992 | Van Engel | 2/67 X |
| 5,143,092 | 9/1992 | Flowers . | |
| 5,363,511 | 11/1994 | Brewer | 2/406 |

FOREIGN PATENT DOCUMENTS

| | | | |
|---|---|---|---|
| 2653976 | 5/1991 | France | 2/400 |

*Primary Examiner*—Jeanette E. Chapman

*Attorney, Agent, or Firm*—Mason, Kolehmainen, Rathburn & Wyss

[57] ABSTRACT

A women's' abdominal support undergarment includes a waistband of horizontally elastic material with its ends joined to the side edges of a one piece control panel of horizontally elastic corset elastic different from the waistband material. The waistband is substantially more elastic than the control panel. The waistband and upper segment of the control panel form a horizontally aligned waist encircling portion on a standing wearer and have a smooth, continuous upper edge. A lower segment of the control panel cooperates with a panty portion and a thong portion to define a depending transverse portion of the garment.

9 Claims, 3 Drawing Sheets

WOMEN'S ABDOMINAL SUPPORT GARMENT

FIELD OF THE INVENTION

The present invention relates to support garments for women, and more particularly to an improved undergarment for controlling abdominal bulge.

DESCRIPTION OF THE PRIOR ART

There are many reasons why women may require abdominal support and control. Abdominal bulge may result from an overweight condition or from bloating related to the menstrual cycle. Scars resulting from Cesarean sections or other surgery may heal with a rippled or bulging effect. Even relatively thin women who do not require support in other areas may have a need for abdominal control. Known abdominal support undergarments have not been suitable for use with a variety of outerwear including aerobic and other exercise wear, swimsuits, tight knit garments and others.

Although there has long been a need for a garment capable of controlling abdominal bulge, an effective solution to the problem has not been achieved prior tot he present invention. Known girdles and foundation garments are intended to provide support not only in the abdominal region but also in other regions. Thus they are larger and less comfortable than would be necessary for control of the abdomen only. Because known garments compress the buttocks and thighs, they result in visible lines at their edges that can be seen through clinging or tight fitting garments. In addition, due to their size and area of coverage, existing support garments are not entirely covered by some types of outer garments such as swimsuits, leotards and the like.

U.S. Pat. No. 5,143,092 attempts to provide one solution to a problem of abdominal bulge. That patent discloses an abdominal flattener that is not an undergarment or lingerie, but rather is intended to be used in a way in which it does not come into contact with the human body. It may be worn over panties or pantyhose, or it may be permanently incorporated into a garment such as a swimsuit. The flattener of that patent includes a non elastic pad overlying the abdomen, and has an angled and looped surround with a discontinuous sharp corner 22 rather than a waistband with a smooth and continuous upper edge that is oriented generally horizontally on a standing wearer. An elastic portion of the flattener at the rear of the wearer overlies a substantial region of the buttocks and would result in an unnatural appearance.

SUMMARY OF THE INVENTION

Among the principal objects of the present invention are to provide a garment that is effective to control the shape and appearance of the abdomen of a wearer without being large, uncomfortable or noticeable; to provide a garment that is worn next to the body as lingerie and is completely hidden even by brief swimwear, exercise wear or the like; and to provide a garment that achieves a natural appearance without visible lines that can be seen through outer clothing.

In brief, in accordance with the present invention there is provided a support garment for controlling bloating, bulging, rippling and the like of the abdomen of a woman wearer. The garment includes a waist encircling portion and a transverse depending portion adapted to extend between the legs of the wearer between the front and the back of the waist encircling portion. The waist encircling portion is generally horizontally positioned upon a standing wearer and has a continuous, smooth upper edge lying substantially in a generally horizontal plane. An abdomen control panel is formed by corset elastic material and overlies the abdomen of the wearer. The control panel extends downwardly from the upper edge to a lower control panel edge spaced below the bottom of the waist encircling portion. The control panel has an upper segment and a lower segment. A waistband formed by waistband elastic material extends from opposite side edges of the upper segment of the control panel and cooperates with the upper segment of the control panel to provide the waist encircling portion. A panty portion and a thong portion are formed by a length of panty material. The panty portion extends from the lower control panel edge to the thong portion, and the thong portion extends from the panty portion between the buttocks of the wearer to the lower edge of the waistband at the rear of the wearer. The lower segment of the control panel and the panty and thong portions provide the transverse depending portion. The control panel and the waistband are elastic in the horizontal direction upon a standing wearer, and the control panel is substantially less elastic than the waistband.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 2:
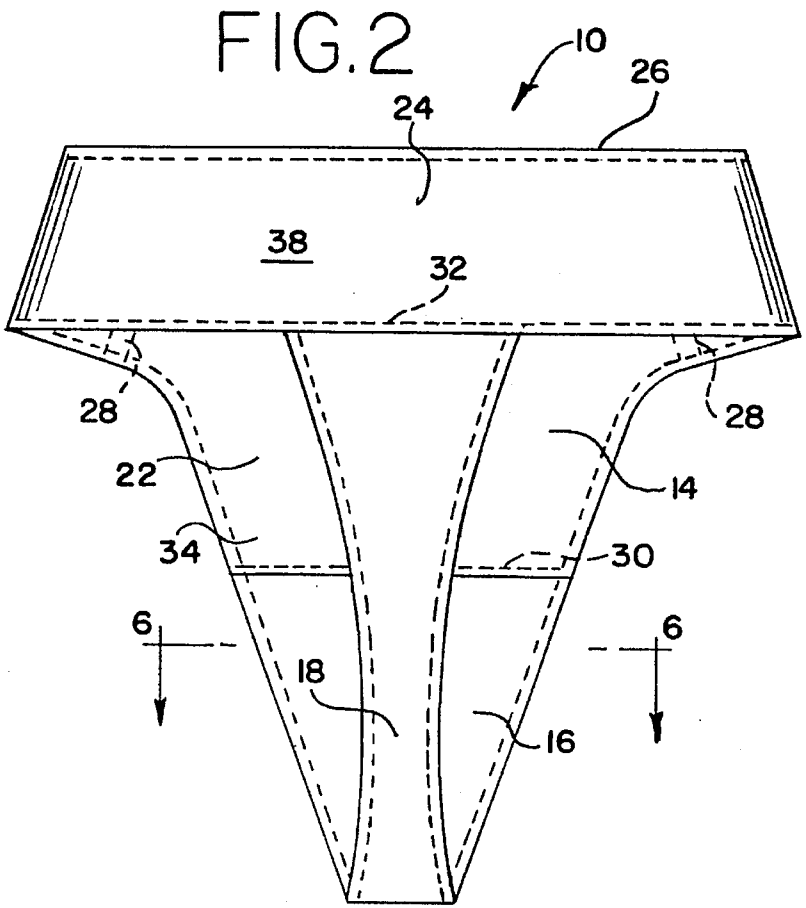
FIG. 2 is a rear view of the garment of FIG. 1.
Figure 1:
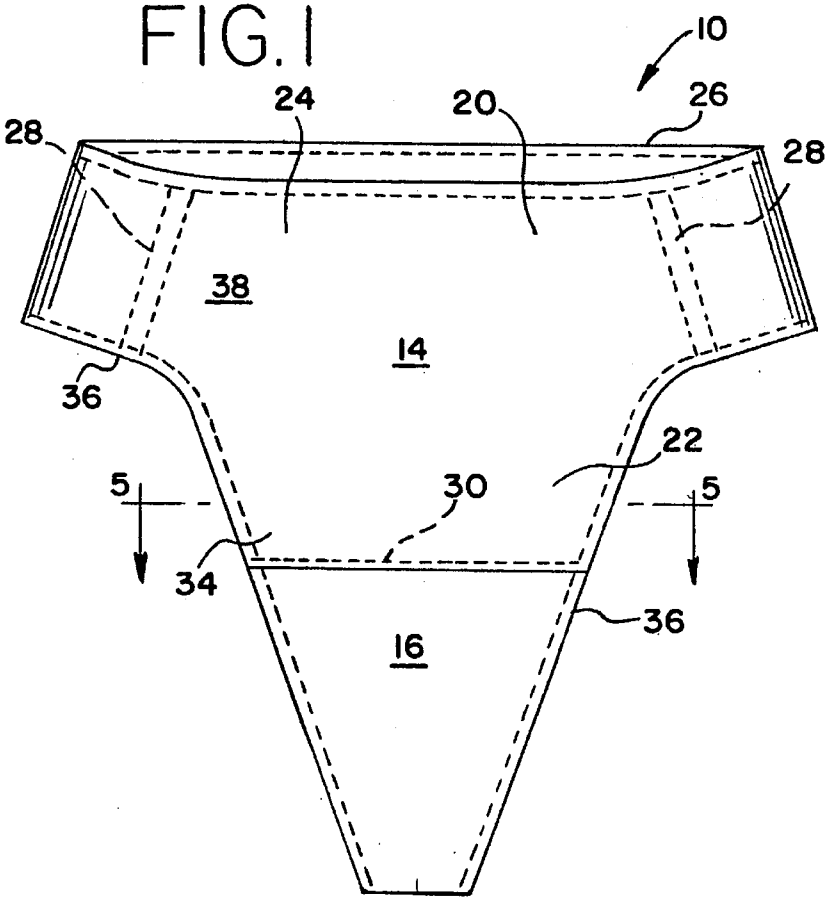
FIG. 1 is a front view of a garment embodying the present invention.
Figure 3:
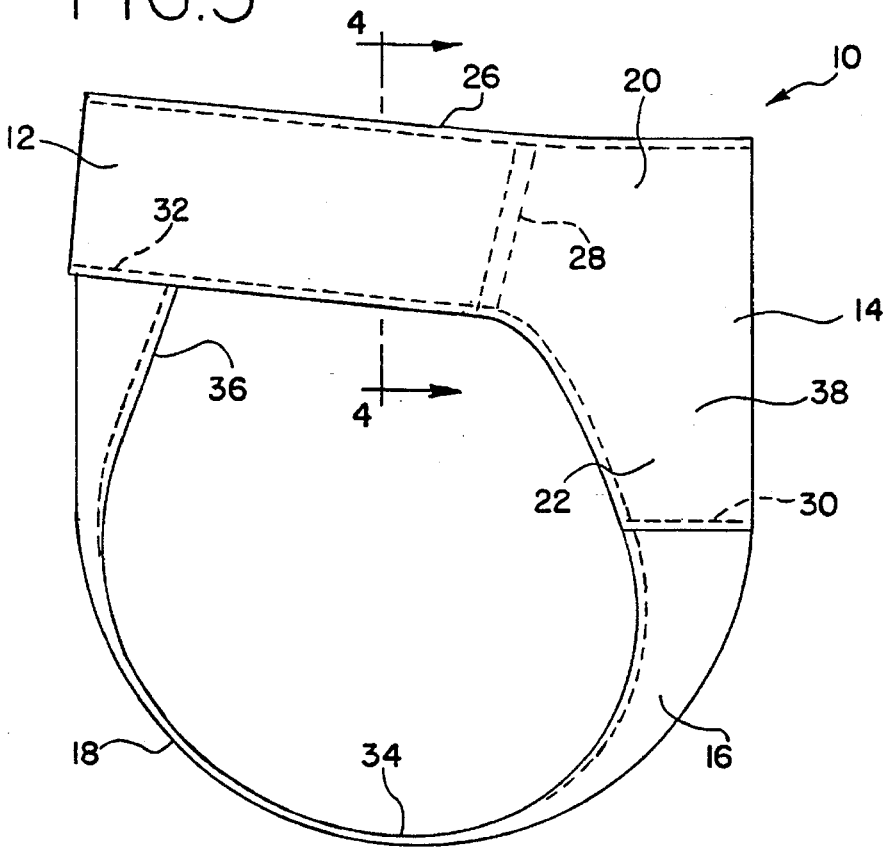
FIG. 3 is a side view of the garment.
Figure 4:
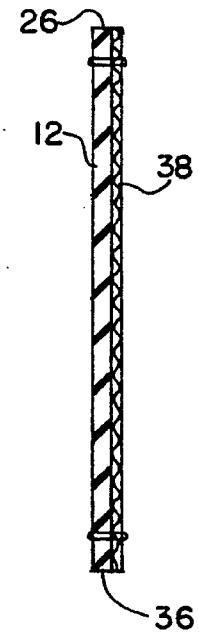
FIG. 4 is an enlarged sectional view of the waistband of the garment, taken along the line 4—4 of FIG. 3.
Figure 5:
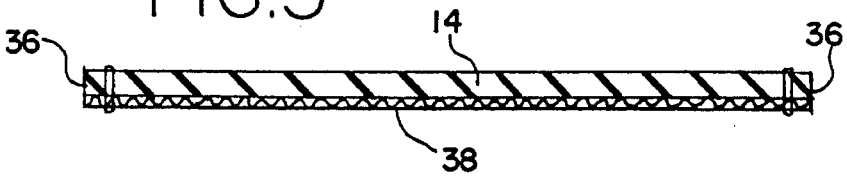
FIG. 5 is an enlarged sectional view of the control panel portion of the garment, taken along the line 5—5 of FIG. 1.
Figure 6:
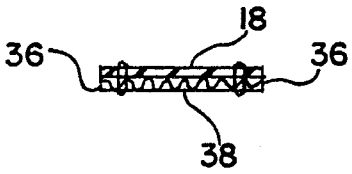
FIG. 6 is an enlarged sectional view of the thong portion of the garment taken along the line 6—6 of FIG. 2.
Figure 8:
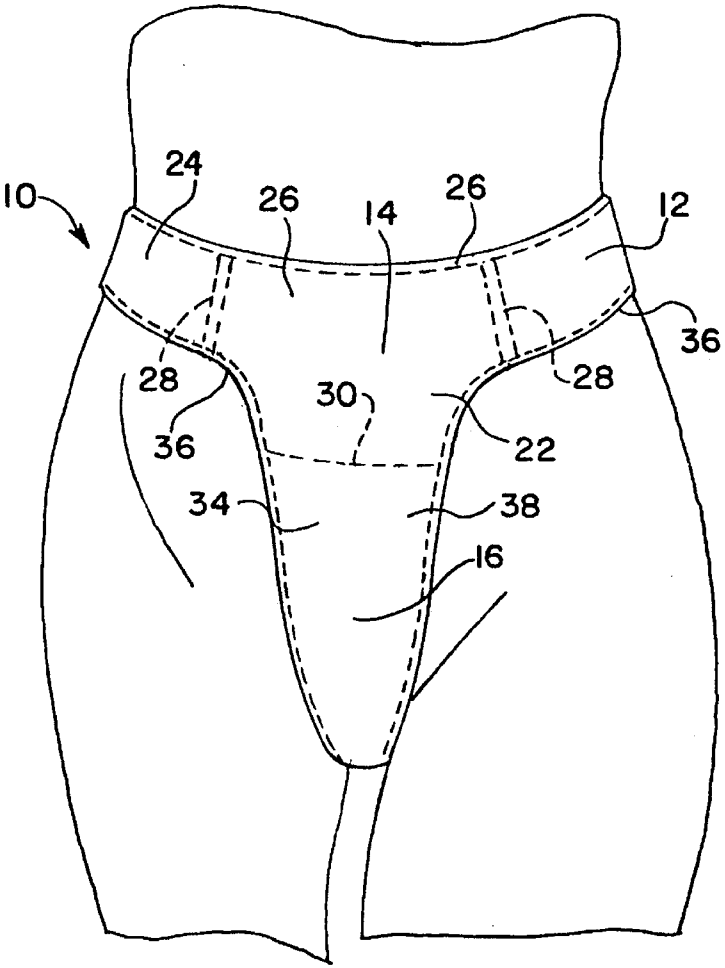
FIG. 8 is a front view of the garment of FIG. 1 seen in place upon a wearer.
Figure 7:
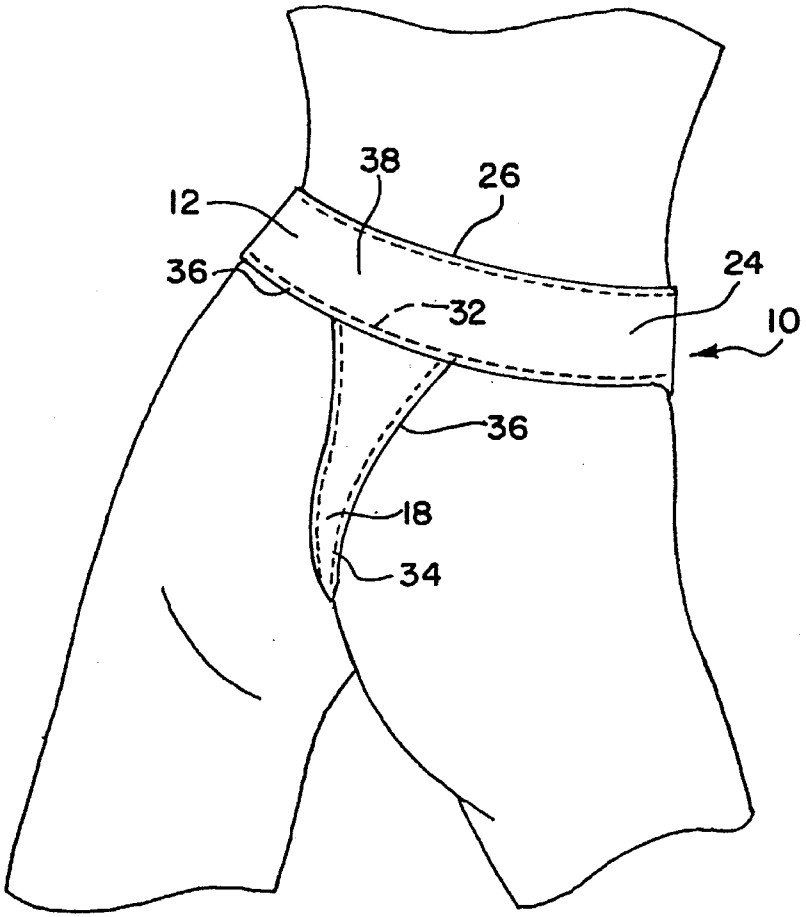
FIG. 7 a rear view of the garment of FIG. 1 seen in place upon a wearer.

Having reference now to the drawings, there is shown a support garment generally designated by the reference character 10 constructed in accordance with the principles of the present invention. The garment 10 may be worn by a woman as illustrated in FIGS. 7 and 8 to achieve support and control of the abdomen in a comfortable and non-obtrusive manner.

In general the garment 10 includes a waistband 12, a control panel 14, a panty portion 16 and a thong portion 18. The control panel 14 is of one piece construction and includes an upper segment 20 aligned with the waistband 12 and a lower segment 22 that extends from the upper segment to the panty portion 16. The upper control panel segment 20 and the waistband 12 cooperate to define a waist encircling portion 24 of the garment 10. As can be seen in FIGS. 7 and 8, the waist encircling portion 24 is oriented in a generally horizontal position upon a standing wearer. The waist encircling portion 24 has an upper edge 26 that is also generally horizontal upon a standing wearer. The upper edge 26 is smooth and continuous and has no angular intersections or other abrupt discontinuities.

The control panel 14 has parallel top and bottom edges. The upper segment 20 has side edges that merge smoothly into the ends of the waistband 12. The lower segment 22 is generally tapered and has side edges that taper inwardly as they extend downward away from the upper edge 24. The upper edge of the panty portion 16 coincides with the lower edge of the control panel 14. The panty portion 16 is tapered from a maximum width where it joins the control panel 14 to a lower region of minimum width where the panty portion merges into the thong portion 18. The thong portion 18 has a narrow width substantially received between the buttocks of the wearer to provide an unobtrusive effect seen in FIG. 7. The upper part of the thong portion 18 increases in width and joins the lower edge of the waistband 12 at the rear of the wearer.

The waistband 12 is preferably a band or web of a single thickness of waistband elastic material that is elastic in the direction of its length, i.e. in the horizontal direction upon a standing wearer, and inelastic in the transverse, vertical direction. A suitable material is a 2.875 inch wide, eighty percent polyester and twenty percent rubber knit or woven material having continuous horizontally extending strands of thirty gauge rubber. The preferred material includes about seven strands of rubber per inch. Such a material is available from Shelby Elastics, Inc. of Shelby, N.C. as style No. K566/OWR. The ends of the waistband 12 are cut to match and merge smoothly with the opposed side edges of the upper segment 20 of the control panel 14 and are sewn to the opposite edges of the upper segment 20 of the control panel 14 at seams 28. The upper edges of the waistband 12 and the control panel 14 are smooth and continuous and are generally horizontal upon a standing wearer.

The control panel 14 is preferably a single thickness of material cut as one piece from a six inch wide band or web of corset elastic. This material is elastic along the length of the web, in the horizontal direction upon a standing wearer, and is inelastic in the transverse, vertical direction. The material may be seventy-three percent single dye polyester and 27 percent rubber, with about 15 strands per inch of thirty gauge rubber strands. Such a material is available from Shelby Elastics, Inc. as style No. S295-6/SRDF. The web of corset elastic is cut so that the original longitudinal edges of the web of material form the parallel top and bottom edges of the control panel 14 and the cut portions form the side edges of the upper and lower segments 20 and 22 of the control panel 14.

Because the elastic rubber strands are spaced substantially closer in the corset elastic than in the waistband elastic, the control panel 14 is substantially less elastic or more resistant to stretching than the waist band 12. Preferably the waistband 12 is approximately twice as elastic as the control panel 14. This arrangement permits the waistband 12 to stretch in order comfortably to accommodate a range of waist sizes and concentrates firm and resilient control at the abdomen of the wearer. The relatively straight, smooth and continuous upper edge 26 contributes to an unobtrusive appearance of the garment 10.

The panty and thong portions 16 and 18 are preferably a single piece of spandex such as eighty six percent nylon and thirteen percent LYCRA spandex, capable of stretching in both directions. A spandex material containing cotton could also be used. If desired, the panty and thong portions 16 and 18 may be lined with a cotton material. The upper edge of the panty portion 16 is sewed to the lower edge of the lower segment 22 of the control panel 14 at a seam 30.

The lower portion of the panty portion 16 merges into and is continuous with the lower portion of the thong portion 18. The thong portion, at its narrowest region, is preferably about one inch wide, so as to be received between and hidden by the buttocks of the wearer. The upper edge of the thong portion is sewn to the lower edge of the central rear portion of the waistband 12 at a seam 32. The lower segment 22 of the control panel 14 together with the panty and thong portions 16 and 18 define a transverse depending portion 34 of the garment 10 that extends between the legs of the wearer from the front to the back of the waist encircling portion 24.

Leg openings 36 are defined at opposite sides of the transverse depending portion 34 by the side edges of the panty and thong portions 16 and 18, by the side edges of the lower segment 22 of the control panel 14 and by the bottom edge of the waistband 12. In order to enhance the appearance of the garment 10, the outer surface of the entire garment may be covered with a decorative stretch lace material 38. Suitable materials are available from Klauber Brothers Inc. Of New York, N.Y. as pattern Nos. 7092-R/52 (seventy percent nylon, nine percent rayon and twenty-one percent spandex), 7009-58 (seventy-nine percent nylon and twenty-one percent spandex) and 7007-BR/54 (eighty-seven percent nylon and thirteen percent spandex). The material 38 is attached to the components of the garment 10 by sewing it along the seams 28, 30 and 32, the edges of the leg openings 36 and along the top edge of the waist encircling portion 24.

While the present invention has been described with reference to the details of the embodiments of the invention shown in the drawing, these details are not intended to limit the scope of the invention as claimed in the appended claims.

What is claimed is:

1. A support garment for controlling bloating, bulging, rippling and the like of the abdomen of a woman wearer, said garment comprising:

a waist encircling portion and a transverse depending portion adapted to extend between the legs of the wearer between the front and the back of said waist encircling portion, said waist encircling portion being generally horizontally positioned upon a standing wearer;

said waist encircling portion having a continuous, smooth upper edge lying substantially in a generally horizontal plane at the waist of a standing wearer;

an abdomen control panel formed by a single layer of a first elastic material and adapted to overlie the abdomen of the wearer, said control panel extending downwardly from said upper edge to a lower control panel edge spaced below the bottom of said waist encircling portion;

said lower control panel edge being generally parallel to said upper edge of said waist encircling portion and being generally horizontal upon a standing wearer;

said control panel having an upper segment and a lower segment;

a waistband formed by a second elastic material differing in elasticity from said first elastic material, said waistband extending from opposite side edges of said upper segment of said control panel and cooperating with the upper segment of said control panel to provide said waist encircling portion, said waistband having a lower edge; and a panty portion and a thong portion formed by a length of panty material, said panty portion extending from said lower control panel edge to said thong portion, and said thong portion extending from said panty portion between the buttocks of the wearer to said lower edge of said waistband at the rear of the wearer;

said panty and thong portions having continuous side edges tapered from a widest region adjacent said lower control panel edge to a narrowest region at the rear of said thong portion;

said lower segment of said control panel and said panty and thong portions cooperating to provide said transverse depending portion;

said control panel and said waistband being elastic in the horizontal direction upon a standing wearer, and said first elastic material of said control panel being substantially less elastic than said second elastic material of said waistband.

2. A support garment as claimed in claim 1, said control panel being substantially non-elastic in the vertical direction upon a standing wearer.

3. A support garment as claimed in claim 1, said control panel and said waistband being substantially non-elastic in the vertical direction upon a standing wearer.

4. A support garment as claimed in claim 1, wherein said waistband is about twice as elastic as said control panel.

5. A support garment as claimed in claim 1, wherein said waistband includes about seven strands per inch of about thirty gauge rubber extending horizontally upon a standing wearer, and said control panel includes about fifteen strands per inch of about thirty gauge rubber extending horizontally upon a standing wearer.

6. A support garment as claimed in claim 1 wherein said control panel consists essentially of a single piece of said first elastic material.

7. A support garment as claimed in claim 6 wherein said lower segment of said control panel tapers in width from a relatively greater width adjacent said upper segment of said control panel to a relatively narrower width adjacent said panty portion.

8. A support garment as claimed in claim 1 wherein said upper edge of said waste encircling portion is characterized by the absence of any sharp discontinuities.

9. A support garment as claimed in claim 1 further comprising a layer of decorative stretch lace material covering said waistband, said control panel, said panty portion and said thong portion.

* * * * *